US005934250A

United States Patent [19]

Fujikawa et al.

[11] Patent Number: 5,934,250

[45] Date of Patent: Aug. 10, 1999

[54] THROTTLE CONTROL APPARATUS

[75] Inventors: Toru Fujikawa, Obu; Masanobu Matsusaka, Handa; Masaru Shimizu, Toyota, all of Japan

[73] Assignee: Aisin Seiki Kabushiki Kaisha, Kariya city, Japan

[21] Appl. No.: 09/048,317

[22] Filed: Mar. 26, 1998

[51] Int. Cl.[6] ..... F02D 7/00

[52] U.S. Cl. ..... 123/399

[58] Field of Search ..... 123/361, 399, 123/400

[56] References Cited

U.S. PATENT DOCUMENTS

| | | | |
|---|---|---|---|
| 5,201,291 | 4/1993 | Katoh et al. | 123/399 |
| 5,517,966 | 5/1996 | Kanazawa et al. | 123/399 |
| 5,738,072 | 4/1998 | Bolte et al. | 123/399 |
| 5,868,114 | 2/1999 | Kaminmura et al. | 123/399 |

FOREIGN PATENT DOCUMENTS

| | | |
|---|---|---|
| 5-163988 | 6/1993 | Japan . |
| 7-97950 | 4/1995 | Japan . |

*Primary Examiner*—Thomas N. Moulis

*Attorney, Agent, or Firm*—Burns, Doane, Swecker & Mathis, LLP

[57] ABSTRACT

A throttle control apparatus controls the amount of inlet air fed to an internal combustion engine on the basis of the degree of opening of a throttle valve. The throttle valve is constituted by a valve body that is fixedly mounted on a valve shaft which is rotatably supported on a housing. The valve shaft is connected, via a reduction mechanism, to an output shaft of a coreless DC motor that is accommodated within the housing. The DC motor is operated to increase or decrease the amount of inlet air to the engine based on a change of the acceleration pedal position, for example by rotating the valve body by way of the valve shaft through an angle that corresponds to the change in position of the accelerator pedal. Employing a DC coreless motor allows the throttle valve to respond to a very quick positioning of the acceleration pedal with a relatively great degree of accuracy.

18 Claims, 2 Drawing Sheets

THROTTLE CONTROL APPARATUS

This application corresponds to and claims priority under 35 U.S.C. § 119 with respect to Japanese Patent Application No. 09 (1997)-78301 filed on Mar. 28, 1997, the entire content of which is incorporated herein by reference.

FIELD OF THE INVENTION

The present invention generally relates to a throttle control. More particularly, the present invention pertains to a throttle control apparatus that controls a motor according to the depression of an accelerator pedal and input from an engine control unit to open and close a throttle valve and thereby control the amount of inlet air fed to the internal combustion engine.

BACKGROUND OF THE INVENTION

A conventional throttle control apparatus is disclosed in Japanese Patent Laid-Open Publication No. Hei 7(1995)-97950. This throttle control apparatus includes a DC motor that sets the position of the throttle valve in response to the corresponding accelerator pedal position. The DC motor is constructed in a way that includes numerous slots formed in the armature core. While such a DC motor can operate relatively quickly upon movement of the accelerator pedal position, the resultant positioning of the throttle valve is not achieved in a satisfactorily accurate manner due to the aforementioned construction of the DC motor.

Another type of known throttle control apparatus which is described in Japanese Patent Laid-Open Publication No. Hei 5(1993)-163988 employs a stepper motor instead of a DC motor. This apparatus, unlike the aforementioned apparatus, can achieve a positioning of the throttle valve with relatively great accuracy. However, the proper positioning of the throttle valve cannot be established in a relatively quick manner in response to the corresponding accelerator pedal position because the stepper motor is not able to rotate at a high speed.

In light of the foregoing, a need exists for a throttle control apparatus that can achieve a highly precise positioning of the throttle valve.

A need also exists for a throttle control apparatus which can establish a precise positioning of the throttle valve in a relatively quick manner.

SUMMARY OF THE INVENTION

Based on the foregoing, the present invention provides a throttle control apparatus for controlling the amount of inlet air fed to an internal combustion engine. The throttle control apparatus includes a housing in which is provided a valve bore for communicating with the internal combustion engine, a valve shaft rotatably mounted with respect to the housing and extending diametrically across the valve bore, and a valve body fixedly mounted on the valve shaft to rotate with the valve shaft. The valve body forms a throttle valve that is positionable at different degrees of opening with respect to the valve bore to control the amount of inlet air fed to the internal combustion by way of the valve bore. A blind bore is formed in the housing and extends parallel to the valve shaft. An end plate is mounted on the housing to close the open end portion of the blind bore and a coreless DC motor is positioned within the blind bore. The motor has one end portion supported on the end plate and an opposite end portion supported at the bottom end portion of the blind bore. The motor also includes an output shaft having one end that extends through the end plate. A reduction mechanism is disposed between the one end of the output shaft and one end of the valve shaft for operatively connecting the output shaft to the valve shaft to transfer movement of the output shaft to the valve shaft.

According to another aspect of the invention, a throttle control apparatus for controlling the amount of inlet air fed to an internal combustion engine includes a housing in which is provided a valve bore for communicating with the internal combustion engine, a valve shaft rotatably mounted in the housing and extending diametrically across the valve bore, a throttle valve fixedly mounted on the valve shaft to rotate with the valve shaft relative to the valve bore to be positionable at different positions defining different degrees of opening of the throttle valve with respect to the valve bore to control the amount of inlet air fed to the internal combustion engine, and a DC coreless motor having an output shaft operatively connected to the valve shaft via a reduction mechanism for rotating the valve shaft to change the degree of opening of the throttle valve. The output shaft has a first end portion that is rotatably supported within the housing and an oppositely located second end portion that is rotatably supported on an end plate disposed in the housing.

In accordance with another aspect of the present invention, a throttle control apparatus for controlling the amount of inlet air fed to an internal combustion engine includes a housing in which is provided a valve bore for communicating with the internal combustion engine, a valve shaft rotatably mounted on the housing and extending diametrically across the valve bore, and a valve body fixedly mounted on the valve shaft to rotate with the valve shaft. The valve body constitutes a throttle valve that is positionable at different positions with respect to the valve bore to define different degrees of opening of the throttle valve with respect to the valve bore to control the amount of inlet air fed to the internal combustion engine. The apparatus also includes a DC coreless motor having an output shaft that is operatively connected to the valve shaft to rotate the valve shaft and adjust the degree of opening of the throttle valve.

BRIEF DESCRIPTION OF THE DRAWING FIGURES

The above and additional features associated with the present invention will become more apparent from the following detailed description considered with reference to the accompanying drawing figures in which like elements are designated by like reference numerals and wherein.

DETAILED DESCRIPTION OF THE INVENTION

Figure 1:
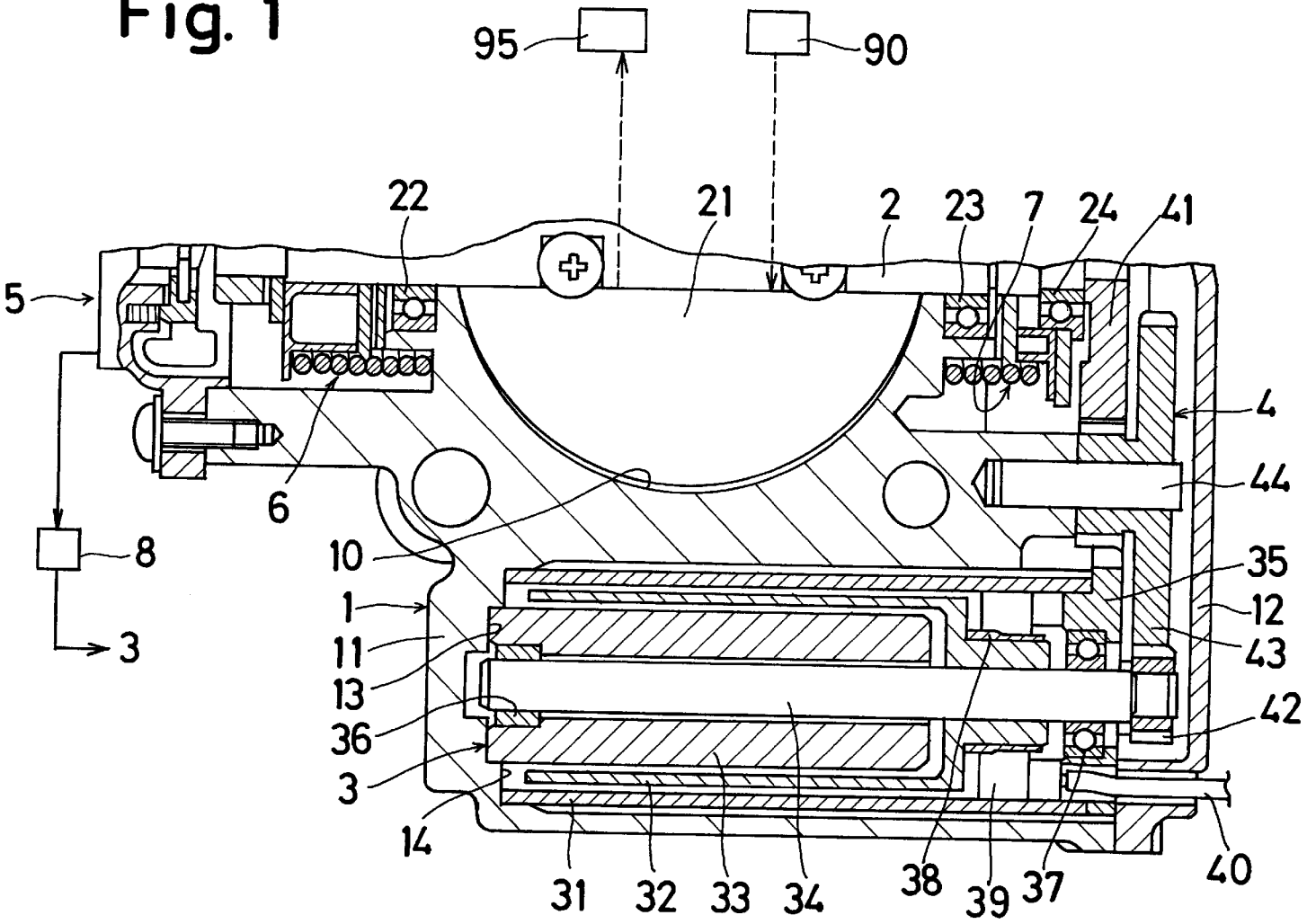
FIG. 1 is a cross-sectional view of a throttle control apparatus according to the present invention.

Referring initially to FIG. 1 which illustrates the main parts of the throttle control apparatus according to the present invention, the throttle control apparatus includes a motor 3 which is operated in accordance with depression of the accelerator pedal 99 (shown in FIG. 2) to open and close the throttle valve. The throttle valve includes a valve member or body 21 which is depicted in FIG. 1. The operation of the motor 3 and subsequent operation of the throttle valve thus controls the amount of inlet air fed to the internal combustion engine 95.

The throttle control apparatus also includes a housing 1 which is made of an aluminum alloy or other material such as iron or a ceramic material. The housing 1 is provided with a valve housing portion 11 in which a valve bore 10 is formed. The valve bore 10 is adapted to communicate with the internal combustion engine. As seen in FIG. 1, the valve bore 10 is disposed between the internal combustion engine 95 and the intake manifold 90. One of the end portions of the housing 1 is provided with an end frame 12 which closes the open end of the housing 1.

A throttle valve shaft 2 is positioned within the valve housing 11 and is rotatably supported at its opposite ends in the valve housing 11 by way of a pair of bearings 22, 23. The throttle shaft 2 extends diametrically across the valve bore 10. The valve member or body 21 is fixed on the throttle shaft 2 and is positioned in the valve bore 10. Thus, the valve body 21 is rotatably disposed in the valve bore 10 for movement between different positions to control the amount of inlet air fed to the internal combustion engine.

One end portion of the throttle shaft 2 is provided with a throttle sensor 5 which detects the rotation angle or angular position of the throttle shaft 2 relative to a plane passing through a diameter of the bore and the axis of the throttle shaft 2. The throttle sensor 5 is thus able to detect the angular position of the throttle valve shaft 2 and the degree of opening of the valve body 21 relative to the valve bore 10. The angular position of the throttle shaft 2, as detected by the sensor 5, indicates the amount of inlet air that is fed to the internal combustion engine 95.

An output gear 41 is fixedly mounted on the other end portion of the throttle shaft 2. The output gear 41 forms a part of a gear reduction mechanism 4 that, as is well known, includes plural gears. The throttle shaft 2 is urged by a return spring 6 in the direction which closes the valve body 21 to decrease the inlet air amount. The throttle shaft 2 is also urged by an opener spring 7 which imparts an urging force to the throttle shaft 2 that opens the valve body 10 to increase the inlet air amount. The value of the urging force associated with the opener spring 7 is fixed such that the degree of opening of the valve body 10 when no current is supplied to the motor 3 is slightly larger than that when the engine is in the idling condition.

A bore 14 is provided in the lower portion of the valve housing 11. This bore 14 is in the form of a cylindrical blind bore having an open end and a closed bottom end 14. The blind bore 14 is parallel to the throttle valve shaft 2 and accommodates or receives the motor 3.

The motor 3 is a coreless DC motor that includes a yoke 31 which is comprised of soft iron and possesses a cylindrical configuration having opposite open ends, a stator having a cylindrically shaped armature coil 32 that includes an open end, a magnetic field magnet 33 made of a permanent magnet and possessing a cylindrical configuration with opposite ends being open, a motor shaft 34, and a thin plated end plate 35. The yoke 31, the armature coil 32, the magnetic field magnet 33 and the motor shaft 34 are all coaxially disposed with respect to one another within the blind bore 14.

The end plate 35 is mounted at the open end of the blind bore 14 and is connected to the valve housing 11 to close the open end of the blind bore 14. Generally speaking, the motor 3 is mounted within the housing such that the motor is supported at its opposite ends. As seen in FIG. 1, the motor shaft 34 is located centrally within the magnetic field magnet 33. One end portion of the motor shaft 34 is supported via a bearing bush 36 on an end of the base portion of the magnetic field magnet 33 while the other end portion of the motor shaft 34 is supported on the end plate 35 via a bearing 37. Except at the end portion of the magnetic field magnet 33 that is supported on the bearing 36, a clearance or gap is defined between the inner surface of the magnetic field magnet 33 and the outer surface of the motor shaft 34.

The base portion of the magnetic field magnet 33 is snugly fitted into a stepped bottom portion of the bore 14 in which the motor 3 is accommodated. The magnetic field magnet 33 is thus supported by the valve housing 11 in a cantilevered manner.

The main portion of the armature coil 32 extends parallel to the motor shaft 34. The portion of the armature coil 32 located close to the bearing 37 is snugly mounted around the motor shaft 34 so that this portion of the armature coil 32 contacts and tightly engages the motor shaft 34. The armature coil 32 includes a wire coil formed into a cylindrical configuration with both end portions of the armature coil 32 being connected to commutators 38 which are electrically isolated from each other. The commutators 38 are connected to respective wires 40 (only one is shown) which receive electric current.

One end portion of the yoke 31 is fitted into a cavity 13 of the bore 14, while the other end portion of the yoke 31 is fitted onto a stepped shoulder portion of the end plate 35. Other features and details associated with the coreless DC motor 3 are known and so a more detailed description of the motor is not included here.

As noted above, one end portion of the motor shaft 34 is supported in a bearing 37 positioned in a hole in the plate 35. That same end portion of the motor shaft 34 also extends axially beyond the end plate 35. A sun gear is fixedly mounted on the portion of the motor shaft 34 that extends beyond the plate 35. The sun gear 42 includes teeth that mesh or engage with the teeth on an intermediate gear 43 that is rotatably connected to the valve housing 11 by a pin 44. The intermediate gear 43 includes teeth that mesh or engage with the teeth on an output gear 41.

Figure 2:
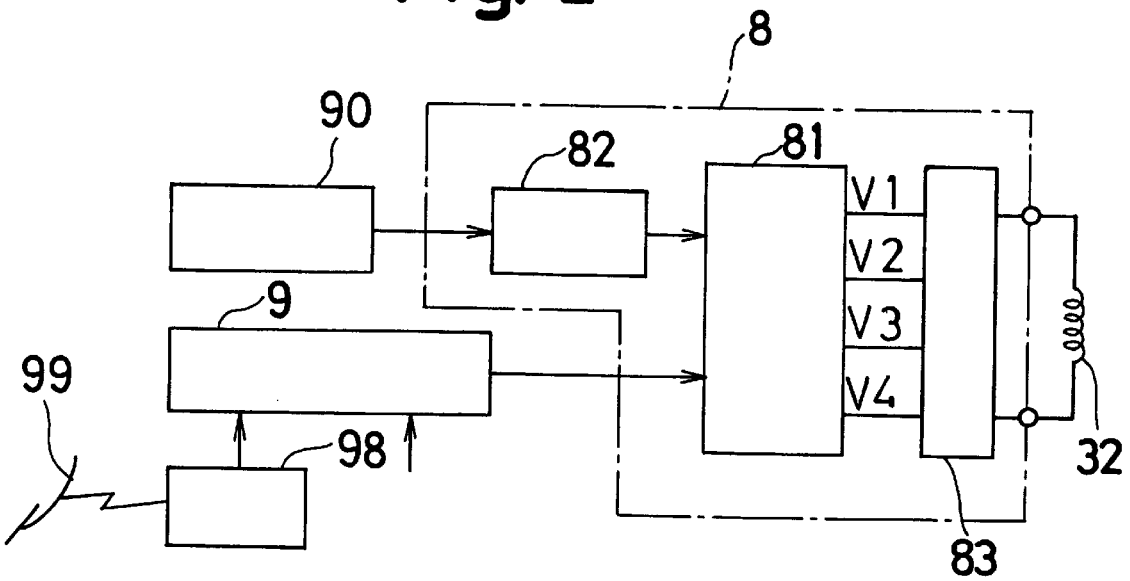
FIG. 2 is a schematic block diagram of the controller used in the throttle control apparatus shown in FIG. 1.

As generally seen in FIG. 1, the throttle control apparatus also includes a controller 8. As illustrated in FIG. 2, the controller 8 includes a microprocessor 81 and is designed to establish a feedback control or PID control on the basis of the throttle sensor 5 indicating the degree of opening of the valve body 21. The controller 8 also includes an A/C converter 82 which converts signals received from the intake manifold 90 into digital signals and feeds the resultant signal to the microprocessor 81. The controller 8 is also provided with a two-way driver circuit 83.

With reference to the illustrations in FIGS. 2 and 3, the throttle control apparatus of the present invention operates in the following manner. An acceleration pedal sensor 98 is connected to the acceleration pedal 99 and outputs a signal indicating the amount of depression of the accelerator pedal 99 or the position of the accelerator pedal 99. The signal output by the accelerator pedal sensor 98 is fed to an engine control unit or ECU 9. In addition, the ECU 9 receives engine related information such as engine temperature. On the basis of the signal from the accelerator pedal sensor 98 and the engine-related information, the ECU 9 determines a target degree of opening signal, with the resulting signal being outputted to the microprocessor 81. The signal indicating the actual degree of opening of the throttle valve or the position of the motor shaft 24 which is outputted from the throttle sensor 5 is converted in the A/C converter 82 to a digital signal, and the resultant signal is then fed to the microprocessor 81.

The microprocessor 81 calculates the deviation between the target degree of opening signal and the actual degrees of opening signal, and then amplifies the resultant value. On the basis of such value, driving signals V1, V2, V3, V4 are fed to the two-way driver circuit 83. Based upon the driving signals V1, V2, V3, V4, the two-way driver circuit 83 establishes a PWM (Pulse Width Modulation Voltage) control with respect to the current supplied to the armature coil 32 of the motor 3. Thus, the valve body 21 on the throttle shaft 2 is kept at the targeted degree of opening which is fixed or determined by the ECU 9 through the feedback control.

Figure 3:
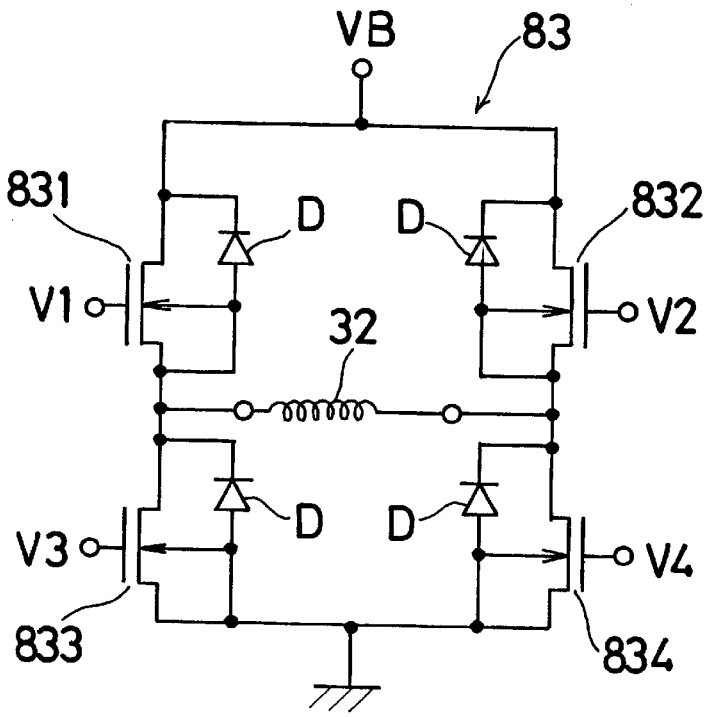
FIG. 3 is a circuit diagram of a two-way driver circuit which forms another part of the throttle control apparatus shown in FIG. 1.

FIG. 3 illustrates a circuit diagram of the two-way driver circuit 83. A first series connection of an N-channel MOS transistor 831 and an N-channel MOS transistor 833 is connected in parallel to a second series connection of an N-channel MOS transistor 832 and an N-channel MOS transistor 834. Each of the transistors 831, 832, 833, 834 is connected in parallel to a flyback diode D. As an alternative to this diode, the corresponding parasitic diode of each transistor is available.

The transistors 831, 832 act as a high side switch and a low side switch, respectively, and these transistors constitute an inverter or driving circuit. Similarly, the transistors 833, 834 act as a high side switch and a low side switch, respectively, and these transistors constitute another inverter or driving circuit. The armature coil 32 of the motor 3 is disposed between the output points of the inverter circuits.

The microprocessor 81 controls the two-way driver circuit 83 in the following manner. When the valve body 21 opens, the output voltages V2, V3, V4, V1 are set to be at a low level, a low level, a high level, and a PWM voltage, respectively. The duty ratio of the PWM voltage varies depending on the deviation between the target degree of opening and the actual degree of opening. Thus, the transistors 832, 833 are designed to be normally OFF, the transistor 834 is set to be normally ON, the transistor 831 is adapted to be under PWM control, and the valve body 21 is opened to the target value.

In contrast, when the valve body 21 closes, the output voltages V1, V4, V3, V2 are set to be at a low level, a low level, a high level, and a PWM voltage, respectively. The duty ratio of the PWM voltage varies depending on the deviation between the target degree of opening and the actual degree of opening. Thus, within the two-way driver circuit 83, the transistors 831, 834 are designed to be normally OFF, the transistor 833 is made to be normally ON, the transistor 832 is adapted to be under PWM control, and the valve body 21 is closed to the target value.

The throttle control apparatus constructed in accordance with the present invention is advantageous in several respects. By employing a coreless DC motor 3 having no or relatively little inertia moment and cogging torque, it is possible to lessen the urging force of the return spring 6 with resultant less output of the motor 3. Thus, miniaturization and a decrease in weight of each of the related parts leads to a quick response of the valve body, and prevents hunting in the feedback control.

The miniaturization and decrease in weight of the elements introduces flexibility with respect to assembly of the throttle control apparatus.

By directly supporting of the magnetic field magnet 33 on the valve housing 11, the distal end portion of the magnet is free from resonant vibration amplification. It is thus possible to achieve a stable holding of the magnetic field magnet within the housing.

Because the motor shaft 34 is supported other than by the housing, the motor 3 is lighter.

Accommodating the motor 3 within the valve housing 11 means that potential electromagnetic noise caused by sparks at the commutator of the motor 3 is prevented from being transmitted outside the valve housing 11. This shield effect is advantageous because the engine control unit and other on-vehicle electric devices are not susceptible to malfunction by the electromagnetic noise.

The principles, a preferred embodiment and the mode of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A throttle control apparatus for controlling an amount of inlet air fed to an internal combustion engine comprising:

a housing in which is provided a valve bore for communicating with the internal combustion engine;

a valve shaft rotatably mounted with respect to the housing and extending diametrically across the valve bore;

a valve body fixedly mounted on the valve shaft to rotate with the valve shaft, the valve body forming a throttle valve that is positionable at different degrees of opening with respect to the valve bore to control the amount of inlet air fed to the internal combustion by way of the valve bore;

a blind bore formed in the housing and extending parallel to the valve shaft, the blind bore having a bottom end portion located at one end and an open end portion at an opposite end;

an end plate mounted on the housing to close the open end portion of the blind bore;

a coreless DC motor positioned within the blind bore, said motor having one end portion supported on the end plate and an opposite end portion supported at the bottom end portion of the blind bore, the motor including an output shaft having one end that extends through the end plate; and a reduction mechanism disposed between said one end of the output shaft and one end of the valve shaft for operatively connecting the output shaft to the valve shaft to transfer movement of the output shaft to the valve shaft.

2. A throttle control apparatus as set forth in claim 1, including a return spring mounted on the valve shaft for urging the valve shaft in a closing direction for closing the throttle valve.

3. A throttle control apparatus as set forth in claim 1, wherein the valve shaft has an axis and including a throttle sensor operatively associated with the valve shaft for detecting an angular position of the valve shaft relative to a plane passing through a diameter of the valve bore and the axis of the valve shaft, said throttle sensor outputting a signal indicative of the angular position of the valve shaft, and including a control device for establishing a feedback-based control of the DC coreless motor based on the signal outputted by the throttle sensor.

4. A throttle control apparatus for controlling an amount of inlet air fed to an internal combustion engine comprising:

a housing in which is provided a valve bore for communicating with the internal combustion engine;

a valve shaft rotatably mounted in the housing and extending diametrically across the valve bore;

a throttle valve fixedly mounted on the valve shaft to rotate with the valve shaft relative to the valve bore to be positionable at different positions defining different degrees of opening of the throttle valve with respect to the valve bore to control the amount of inlet air fed to the internal combustion engine; and a DC coreless motor having an output shaft operatively connected to the valve shaft via a reduction mechanism for rotating the valve shaft to change the degree of opening of the throttle valve, the output shaft having a first end portion that is rotatably supported within the housing and an oppositely located second end portion that is rotatably supported on an end plate disposed in the housing.

5. A throttle control device as set forth in claim 4, wherein the DC coreless motor is positioned within the housing and is provided with a commutator, the DC coreless motor including a stator having a cylindrically shaped armature connected to the output shaft, a cylindrically shaped magnetic field magnet mounted within the housing in a cantilever fashion and disposed within the armature coil, and a yoke surrounding the armature coil.

6. A throttle control apparatus as set forth in claim 4, including a return spring mounted on the valve shaft for urging the valve shaft in a closing direction for closing the throttle valve and an opener spring mounted on the valve shaft for urging the valve shaft in an opening direction for opening the throttle valve.

7. A throttle control apparatus as set forth in claim 4, wherein the reduction mechanism includes an output gear mounted on the throttle shaft, a sun gear mounted on an end of the output shaft of the motor that extends beyond the end plate and an intermediate gear, the output gear meshing with the intermediate gear and the intermediate gear meshing with the sun gear.

8. A throttle control apparatus as set forth in claim 4, wherein the valve shaft has an axis and including a throttle sensor operatively associated with the valve shaft for detecting an angular position of the valve shaft, said throttle sensor outputting a signal indicative of the angular position of the valve shaft.

9. A throttle control apparatus as set forth in claim 8, including a control device for establishing a feedback-based control of the DC coreless motor based on the signal outputted by the throttle sensor.

10. A throttle control apparatus for controlling an amount of inlet air fed to an internal combustion engine comprising:

a housing in which is provided a valve bore for communicating with the internal combustion engine;

a valve shaft rotatably mounted on the housing and extending diametrically across the valve bore;

a valve body fixedly mounted on the valve shaft to rotate with the valve shaft, the valve body constituting a throttle valve that is positionable at different positions with respect to the valve bore to define different degrees of opening of the throttle valve with respect to the valve bore to control the amount of inlet air fed to the internal combustion engine; and a DC coreless motor having an output shaft that is operatively connected to the valve shaft to rotate the valve shaft and adjust the degree of opening of the throttle valve.

11. A throttle control apparatus as set forth in claim 10, wherein said housing is provided with a bore in which is located the DC coreless motor.

12. A throttle control apparatus as set forth in claim 10, including a return spring mounted on the valve shaft for urging the valve shaft in a closing direction for closing the throttle valve.

13. A throttle control device as set forth in claim 12, wherein the DC coreless motor is provided with a commutator and includes a stator having a cylindrically shaped armature connected to the output shaft of the motor, a cylindrically shaped magnetic field magnet mounted within the housing in a cantilever manner and positioned within the armature coil, and a yoke surrounding the armature coil.

14. A throttle control apparatus as set forth in claim 13, wherein the DC coreless motor is positioned within a bore in the housing, one end portion of the output shaft being rotatably mounted in the bore in the housing via the magnetic field magnet and an opposite end portion of the output shaft being rotatably mounted in the bore in the housing via an end plate, the end plate being connected to the housing to close an open end of the bore in the housing.

15. A throttle control apparatus as set forth in claim 14, wherein the magnetic field magnet has one end portion that is directly connected to the housing.

16. A throttle control apparatus as set forth in claim 15, wherein an outer periphery of said one end portion of the magnetic field magnet is snugly fitted in a stepped portion of the bore in the housing.

17. A throttle control apparatus as set forth in claim 13, wherein the valve shaft has an axis and including a throttle sensor operatively associated with the valve shaft for detecting an angular position of the valve shaft relative to a plane passing through a diameter of the valve bore and the axis of the valve shaft, said throttle sensor outputting a signal indicative of the angular position of the valve shaft, and including a control device for establishing a feedback-based control of the DC coreless motor based on the signal outputted by the throttle sensor.

18. A throttle control apparatus as set forth in claim 10, wherein the DC coreless motor is accommodated within the housing.

* * * * *

UNITED STATES PATENT AND TRADEMARK OFFICE

CERTIFICATE OF CORRECTION

PATENT NO. : 5,934,250

DATED : August 10, 1999

INVENTOR(S) : Toru FUJIKAWA et al

It is certified that error appears in the above-indentified patent and that said Letters Patent is hereby corrected as shown below:

On the title page add:

-- [30] Foreign Application Priority Data

March 28, 1997 [JP] Japan ..... 9-78301--

Signed and Sealed this

Nineteenth Day of September, 2000

*Attest:*

Q. TODD DICKINSON

*Attesting Officer*

*Director of Patents and Trademarks*